US010536782B2

(12) United States Patent
Kah, Jr.

(10) Patent No.: US 10,536,782 B2
(45) Date of Patent: Jan. 14, 2020

(54) EXTERNAL EAR INSERT FOR HEARING ENHANCEMENT

(71) Applicant: Carl L. C. Kah, Jr., North Palm Beach, FL (US)

(72) Inventor: Carl L. C. Kah, Jr., North Palm Beach, FL (US)

( * ) Notice: Subject to any disclaimer, the term of this patent is extended or adjusted under 35 U.S.C. 154(b) by 0 days.

(21) Appl. No.: 15/194,713

(22) Filed: Jun. 28, 2016

(65) Prior Publication Data

US 2017/0006387 A1 Jan. 5, 2017

Related U.S. Application Data

(60) Provisional application No. 62/187,993, filed on Jul. 2, 2015.

(51) Int. Cl.
*H04R 25/02* (2006.01)
*H04R 25/00* (2006.01)

(52) U.S. Cl.
CPC ..... *H04R 25/02* (2013.01); *H04R 25/48* (2013.01); *H04R 25/505* (2013.01); *H04R 25/604* (2013.01); *H04R 2225/025* (2013.01)

(58) Field of Classification Search
CPC .... H04R 1/1008; H04R 1/1016; H04R 1/105; H04R 1/1066; H04R 1/1075; H04R 1/1091; H04R 25/02; H04R 25/48; H04R 25/505; H04R 25/604; H04R 25/608; H04R 25/652; H04R 25/658; H04R 2225/025; H04R 2460/09; H04R 2460/11
See application file for complete search history.

(56) References Cited

U.S. PATENT DOCUMENTS

| | | | | |
|---|---|---|---|---|
| 6,356,644 | B1 * | 3/2002 | Pollak | H04R 1/1008 181/129 |
| 2001/0031062 | A1 * | 10/2001 | Terai | H04R 5/033 381/370 |
| 2003/0231783 | A1 * | 12/2003 | Kah, Jr. | H04R 25/356 381/322 |
| 2009/0123010 | A1 | 5/2009 | Cano et al. | |
| 2009/0238398 | A1 | 9/2009 | Connors et al. | |
| 2011/0150258 | A1 * | 6/2011 | Kah, Jr. | H04R 25/356 381/328 |
| 2013/0259239 | A1 | 10/2013 | Aubreville et al. | |
| 2013/0343585 | A1 * | 12/2013 | Bennett | H04R 25/554 381/315 |

(Continued)

FOREIGN PATENT DOCUMENTS

| | | | |
|---|---|---|---|
| JP | 2010-147739 | A | 7/2010 |
| WO | WO 9844763 | A1 | 10/1998 |
| WO | WO 2012138788 | A2 | 10/2012 |

OTHER PUBLICATIONS

International Search Report and Written Opinion dated Oct. 14, 2016 in corresponding International Application No. PCT/US2016/039812.

(Continued)

*Primary Examiner* — Joshua Kaufman
(74) *Attorney, Agent, or Firm* — Amster, Rothstein & Ebenstein LLP

(57) ABSTRACT

A hearing enhancement device using wave amplification in the outer ear cavities of a user and transducer placement to provide frequency based enhancement of speech and music sounds without blocking the user's auditory canal.

6 Claims, 21 Drawing Sheets

(56) References Cited

U.S. PATENT DOCUMENTS

| | | | |
|---|---|---|---|
| 2014/0314238 | A1 | 10/2014 | Usher et al. |
| 2015/0098581 | A1 | 4/2015 | Harvey |

OTHER PUBLICATIONS

European Search Report and European Search Opinion dated Nov. 9, 2018 issued in corresponding European Application No. 16818595.7.

* cited by examiner

EXTERNAL EAR INSERT FOR HEARING ENHANCEMENT

CROSS-REFERENCE TO RELATED APPLICATIONS

The present application claims benefit of and priority to U.S. Provisional Patent Application Ser. No. 62/187,993 entitled EXTERNAL EAR INSERT FOR HEARING ENHANCEMENT filed Jul. 2, 2015, the entire content of which is hereby incorporated by reference herein.

BACKGROUND

Field of the Disclosure

The present invention relates to hearing enhancement devices and hearing enhancement by selected electronic amplification of frequency bands input at select ear locations.

Related Art

An estimated 5-10% of the U.S. population, and more that 50% of the population over sixty years of age, has hearing loss, primarily of high frequencies. Similar numbers have been stated for other parts of the world, such as India. The largest population of people with hearing impairment have normal hearing in the low frequency ranges and hearing loss in the higher frequency ranges. Most problematic for people with mild hearing loss are high frequency sounds.

Most hearing aids have their amplifying transducer fitted into the ear canal (the external auditory canal). They employ signal processing techniques to rebuild sounds throughout the usable frequency range of the user. A drawback is that such hearing aids typically block the outer ear and ear canal to prevent feedback and whistling since the higher gains, greater than 30 db which are used to allow a user to have better speech comprehension feed back from the amplifying transducer to the hearing aid microphone if the transducer is not sealed off in the ear canal. Conventional hearing aids can unnecessarily amplify sound in a manner that may be uncomfortable and annoying for users with mild hearing loss. Also, they may introduce phase shifts to received sounds, resulting in a reduction of the user's ability to localize sound sources. Sounds of high amplitude may be distorted by the sound processing circuitry. In addition, such devices may produce an occlusion effect, due to transmission of sound by tissue conduction as a result of the blockage of the ear canal and impedance of air conduction. This can have the effect of increased loudness of some frequency ranges, resulting in sounds that seem unnatural and uncomfortable, and the user may not even recognize his own voice.

With such devices, electronic frequency band matched amplitude amplification to match the patient's hearing is difficult, particularly where the user still has reasonably normal hearing at least at lower frequencies of the natural ambient sound field. This is because distortion and over-amplification of background noise can occur and is difficult to eliminate to provide the same experience as the user's natural hearing.

The entire contents of U.S. Pat. No. 7,916,884, issued Mar. 29, 2011, U.S. Pat. No. 8,750,547, issued Jun. 10, 2014, U.S. Pat. No. 5,987,146, issued Nov. 16, 1999, U.S. Pat. Nos. 4,904,708, 5,276,739, 5,278,912, and 5,488,668, 9,167,364 and PCT International Application No. PCT/US03/14973, filed May 12, 2003, are incorporated in full herein by reference.

For good or acceptable human voice or word comprehension, many patients need only a small boost of higher frequencies, which is where most of the hearing loss in later life occurs. In particular, hearing loss at higher frequencies is often in the range of 30 dB or more. Amplification at such levels often results in whistle and feedback. This is generally dealt with by sealing the hearing aid speaker transducer to the wall of the auditory canal. Natural hearing, even in the portions of the spectrum for which there is little of no hearing impairment, must thus be foregone. Vent holes are sometimes provided to allow through some normal sound, but there is still substantial attenuation of ambient sound waves.

As a consequence, many persons with only high frequency hearing impairment find electronic hearing aids to be unsatisfactory, and simply accept the impairment as an unavoidable consequence of aging.

A need exists for an improved hearing enhancement device usable by those with high frequency hearing impairment for whom existing amplified devices are not completely satisfactory and that avoids the problems discussed above.

SUMMARY

The present invention meets this need by means of a passive device that may be inserted into the outer ear concha or pinna, and used with or without additional electronic amplification, to provide selective or broad-frequency gain at higher frequencies due to natural frequency resonance by the outer ear passages.

The device may be made in several configurations, may be made of clear flexible plastic materials, and electronic amplifiers may be mounted behind the upper outer ear pinna, as is common for electronic hearing amplifier devices now on the market.

The frequency amplitude gain response of the auditory canal and the tympanic membrane may be enhanced by varying the front to back dimensions thereof by adjusting where the sound transducer(s) (speaker(s)) from the electronic amplification are placed for input to the auditory canal. This greatly improves speech comprehension and reduces amplification gain levels required from the electronically amplified sound.

Hearing losses or hearing impairment is classified according to the volume of sound above normal required for a person to detect it or to comprehend it. For example, hearing loss of 30 dB from normal may be classified as mild hearing loss, 50 dB losses are classified as moderate hearing loss, and 80 dB losses are classified as severe hearing loss.

Each of the phonic units of spoken speech includes complex sound wave forms composed of several frequencies clustered in definable ranges. These can be electronically analyzed using a Fourier mathematical analysis into their separate component frequencies of definite amplitude and phase.

With the advent of new, very fast and very small computer circuits this technology can be made available for selective hearing and comprehension enhancement. This allows for amplification of selected frequency components in real time to users with known losses in the frequency ranges corresponding to speech sounds at below feedback amplitudes and all frequencies to be mixed using the user's concha and ear canal as a resonating chamber and tube.

Additionally, the ear insert may be fitted with high quality sound transducers positioned to provide selected frequency enhancement by resonance and reverberation. This may be the configuration of choice for inputting recorded music as electronic amplified sound into the user's ears. Many young people operate their music ear buds and earphones at excessive volumes, which can lead to future hearing loss, because it provides beautiful higher frequency music harmonics at their threshold sound level that they now can hear when setting the volume very high, and are more pleasurable. The ear gets used to the volume of the music, but it can be very damaging over time resulting in long-term hearing loss. If these higher frequencies could be harmonically wave amplified by the configuration of the external ear insert and input transducer of the present disclosure, then the overall loudness of the sound would not have to be elevated to damaging levels to hear the fullness of the musical sounds.

The present invention relates to ways of providing sound to the human ear at higher gains without the need to seal the input speaker to the ear canal to prevent feedback and squealing.

According to an aspect of the disclosure, the hearing enhancement device includes electronically amplified transducers, which may be positioned at selected outer ear locations to improve open ear hearing with selected frequency enhancement by the outer ear's natural resonance even without ear cup enhancement.

According to another aspect of the disclosure, a hearing aid electronic amplifier includes a microprocessor that performs Fourier analysis of complex phonic sound waves, with the amplifier providing gain only of those frequencies in a target range in which the user has hearing loss in excess of what may be provided naturally by the enhanced resonance provided by the external ear insert. The outer ear and ear canal may thus remain fully open to all sounds normally heard by the user. For example, high frequency speech phonics components and other sounds in a frequency range in which there is hearing loss may be added into the fully open ear canal, and this may be done without causing feedback, squeal or whistle by having transducers strategically located. There may thus be no need for a hearing aid amplifier that provides sound amplification for the entire frequency range, as is common in many conventional hearing aids.

Since the pitch of human speech is between 80 Hz and 300 Hz and from 250 Hz for soprano voices, these frequencies are within the functional range of most people even with mild or moderate hearing loss.

Speech phonics or vowels and consonants contain complex wave forms with high frequency components that may be broken down using Fourier mathematics to identify their higher frequency wave components. In an embodiment, only those higher frequency components are amplified to overcome the user's hearing loss at those frequencies.

Since frequencies contained in speech phonics received at the human ear are typically not repetitive, such as pure tones can be, they are less likely to be repetitively reinforced and resulting feedback and squeal. For this reason, selected phonic component/higher frequency wave components may be provided at greater gain levels without feedback and squeal and without the need to seal the input speaker to the wall of the ear canal, and they may require a smaller gain level than do solid tones.

The incoming sound from the outside and the amplified sound provided from the electronic amplifier speaker may be considered the forcing vibration for hearing. When some frequency components of these forcing vibrations have the same frequency as the free vibration resonant frequency of some of the surfaces function inside of the outer ear and cup, concha, and ear canal, the resulting free vibrations of the resonant cavity surfaces will reinforce the received ones to provide the selective frequency gain attributed to this resonance which is the functional concept of this invention; i.e. two waves of the same frequency in phase with each other and moving in the same direction reinforce each other to produce amplitude gain in that frequency.

Disclosed is a hearing enhancement device including an earpiece that includes: a forwardly opening cup-shaped member configured to cause substantially no obstruction to sound entering from in front of the user, and substantially no obstruction of the ear canal; a forwardly facing concave surface; a rearwardly facing convex surface including: front edges delimited by a forwardly facing edge, and an outer marginal portion around an outside, the outer marginal portion configured to be captured by surrounding ear cartilage; a transducer mounting boss positioned on the convex surface and having a transducer mounting aperture; and an amplifier-driven transducer positioned and configured to deliver sound to the ear canal without substantially obstructing the ear canal and positionally directed by the transducer mounting boss.

Such an earpiece may be positioned in a user's concha, and to be held in position by surrounding cartilage.

Such a hearing enhancement device may also include a terminal element positioned on an upper end of the cup-shaped element, and shaped and positioned to engage an upper end of a helix of the user's ear.

In such a hearing enhancement device, the cup-shaped member may be shaped and positioned to fit outside of the opening of an auditory passage in the concha and against the antihelix of the user's ear.

Such a hearing enhancement device may also include: front edges of a front facing surface delimited by a forward facing first marginal portion, the first marginal portion extending more forwardly at a lower end thereof than the second marginal portion, and the second marginal portion extending more forwardly at an upper end thereof than the first marginal portion.

In such a hearing enhancement device, the front facing and rear facing surfaces, and the first and second marginal portions are so shaped and dimensioned such that the earpiece interacts with the auditory canal to amplify sound as a function of frequency to provide selective amplitude enhancement.

The cup-shaped member may be inserted in the user's outer ear and shaped to interact with the auditory canal to amplify sound as a function of frequency.

The cup-shaped device may include portions that engage with the cartilaginous structures of the pinna to retain the earpiece in place.

Such a hearing enhancement device may further include an electronic amplifier; and a speaker transducer acoustically coupled to the user's ear, wherein the amplifier is connected to the speaker transducer so as to drive the speaker transducer. The amplifier-driven sound speaker transducer may be detachably connected to the amplifier. The sound speaker transducer may be detachably mounted on the cup-shaped member, and the hearing enhancement device includes a sound conducting tube acoustically coupling the amplifier-driven sound speaker transducer to the user's ear.

A hearing enhancement device in accordance with an embodiment of the present disclosure includes a first speaker transducer; an electronic amplifier, the electronic amplifier including a harmonic analyzer separating out predetermined high frequency component frequencies, and a signal amplifier providing additional amplification only of the predetermined high frequency component frequencies and driving the speaker transducer to produce only the predetermined high frequency component frequencies to the user's ear.

Such a hearing enhancement device may further include an earpiece that includes: a forwardly opening cup-shaped member configured to cause substantially no obstruction to sound entering from in front of the user, and substantially no obstruction of the ear canal; a forwardly facing concave surface; a rearwardly facing convex surface including: front edges delimited by a forwardly facing edge, and an outer marginal portion around an outside, the outer marginal portion configured to be captured by surrounding ear cartilage; a transducer mounting boss positioned on the convex surface and having a transducer mounting aperture; and an amplifier-driven transducer positioned and configured to deliver sound to the ear canal without substantially obstructing the ear canal and positionally directed by the transducer mounting boss.

The harmonic analyzer may use Fourier mathematical analysis of speech complex wave forms to separate out predetermined high frequency component frequencies.

The hearing enhancement device may further include: a second speaker transducer configured to be driven at a frequency range different from the predetermined high frequency component frequencies. The first speaker transducer may be positioned by a first transducer mounting boss positioned at so as to be directed toward a circumference of the concha and the second speaker transducer may be positioned by a second transducer mounting boss positioned so as to direct sound toward the ear drum (tympanic membrane) through the ear canal.

According to an aspect of the disclosure, a hearing enhancement device worn in the concha of the outer ear may provide a fully open auditory canal sound entry to the auditory canal and ear drum, and enhanced sound frequency gains due to natural outer ear resonance, which may prove adequate for people with moderate or middle level hearing loss. Sound level amplification may be provided by an electronic amplifier transducer inserted into the transducer speaker mounting holes in the concha mounted hearing enhancement device.

According to an aspect of the disclosure, outer ear mounted electronic speech transducer inserts, which may be used without an ear cup, may provide selected sound frequency amplification at amplification levels below feedback levels, which may thus allow fully open ear hearing and speech comprehension.

A procedure for designing and optimizing the shape of the earpieces is also contemplated. This may be accomplished by placing a small microphone in the auditory canal near the eardrum, for example, 1 or 2 millimeters from the eardrum, and then measuring the received signal level of sound amplitude received for various frequencies of sound from a speaker transducer located outside of the ear.

In this way, the sound level gain for each frequency can be measured in the auditory canal and the shape of the earpiece adjusted to maximize the sound level gain at the frequencies that give the user the best hearing comprehension of words when tested at various sound levels. Average data can thus be obtained and used to design standardized earpieces with resonance peaks and shapes that can provide best fit on a statistical basis for most users. Tuning for specific user's needs can be provided by standardized or customized inserts for use with the standardized earpieces or by selective amplification. In an embodiment, a removable outer ear mold piece may be made using soft two component plastic and removed from the user's outer ear after it sets. This technique is used by professional audiologists. Using the mold piece, a replica of the outer ear of the user can be made. This replica is then preferably optically scanned to generate a model of the outer ear of the user that can be analyzed to determine the resonance thereof. In addition, the model may be used to test the effectiveness of various shapes for the out ear insert or ear piece such that its shape can be optimized for the patient before being produced. Production may take place using 3 D printing, for example, or any other suitable process.

Also, custom ear pieces may be 3D printed/manufactured from suitable materials, for example, from an ear mold that is laser scanned to provide the user's own outer ear internal shape and dimensions for making the 3D process as noted above.

A hearing enhancement device in accordance with another embodiment of the present disclosure includes a first transducer boss mounted in a user's ear at a first position, a first transducer mounted in the first transducer boss, an electronic amplifier configured and operable to amplify a selected high frequency portion of incoming sound and to drive the first transducer with a signal based on the high frequency portion, wherein the first transducer is positioned relative to a concha and auditory canal of the user such that reproduced sound provided by the first transducer is enhanced by resonance in the auditory canal as shown in the exemplary embodiments of FIGS. 13 and 14.

Other features and advantages of the present invention will become apparent from the following description of the invention, which refers to the accompanying drawings.

DETAILED DESCRIPTION OF THE EMBODIMENTS

Figure 1:
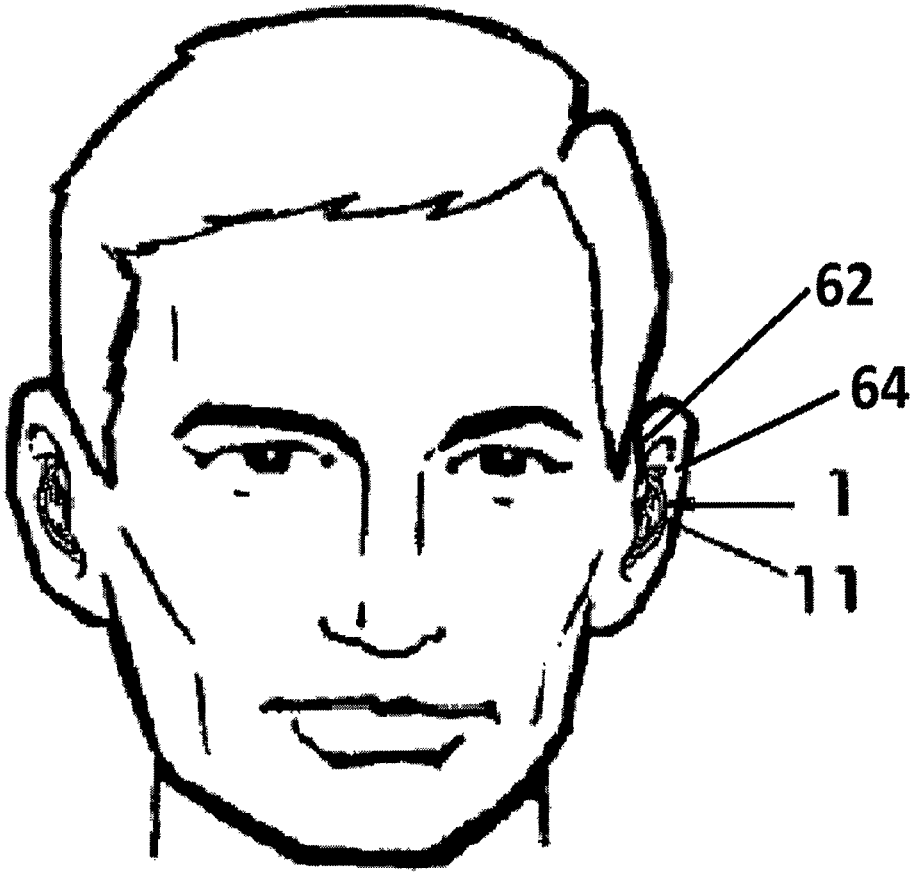
FIG. 1 is a front view of a man's face and head showing the external ears with a hearing enhancement device in place and with an electronic amplifier behind his left ear pinna and a connecting wire connected to a sound transducer at the top of the hearing enhancement device, according to an aspect of the disclosure.

In FIG. 1, a man's face and head are shown with an open ear canal hearing aid enhancement cup or earpiece 1 and behind the upper ear electronic amplifier 60, in accordance with an embodiment of the present disclosure in place on the left side of his head. Just earpiece 1 is illustrated in his right outer ear concha. As may best be seen in FIGS. 1, 3, 4, 5 and 6, earpiece 1 may be a scoop-like structure having variable three dimensional curvature in a horizontal plane.

The earpiece 1 of the left ear is illustrated. An earpiece used in the right ear may be a mirror image of the left earpiece. The earpiece 1 may be formed of any suitable or desired plastic material, such as silicone rubber or the like, may be made transparent (clear or flesh tone), and may be flexible to the desired extent, and may be elastic.

Figure 3:
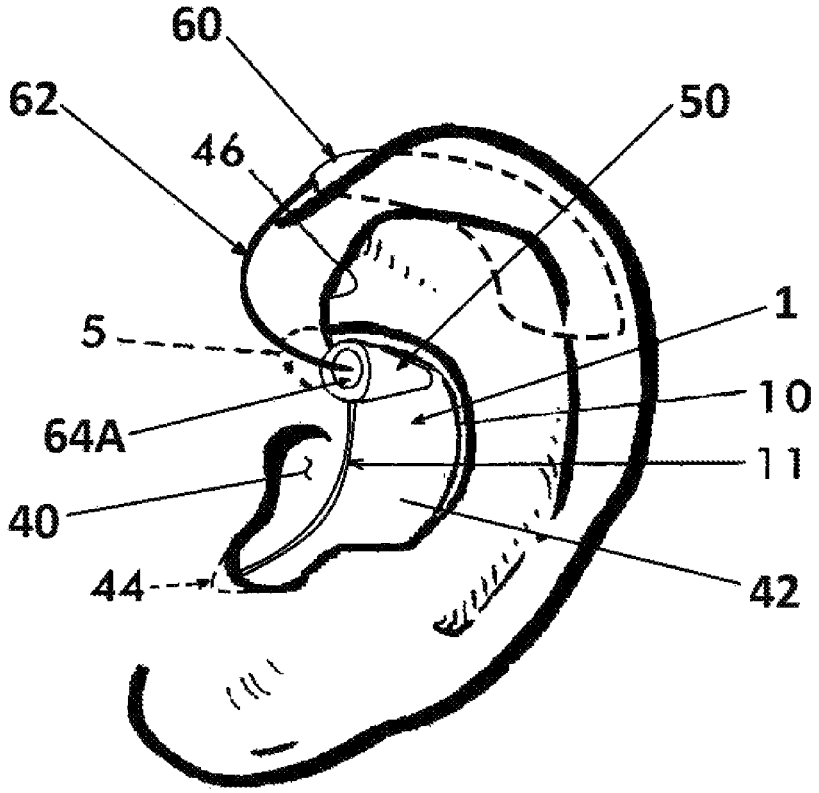
FIG. 3 illustrates the hearing enhancement device in place in the outer left ear and the entry hole for the amplifier transducer with the transducer as shown in FIG. 2A inserted, according to an aspect of the disclosure.

Earpiece 1 may include a forward facing concave portion 42 with an inside sound capture surface. FIG. 3 shows a rearward facing convex surface sound capture cup surface 42 and a forward open area 40 that is free of obstruction and defined by edge 11 of the convex surface. Rearward facing convex surface sound capture cup surface 42 may be on, or may comprise, the side of earpiece that is toward the outside, the side facing away from the ear.

Earpiece 1 is preferably held or captured in the wearer's concha cartilage ridge (antihelix) 10. Earpiece 1 may have a surface that converges at the bottom end thereof to form a lower retention tip 44, and also converges at the top where it merges into a marginal upper retention lug 5 which engages behind the upper end of outer ridge (helix) 46 in a cavity that is formed there by the outer pinna and inner antihelix, fossa area of the antihelix. Retention lug 5 of earpiece 1 may extend well into this area to provide good retention in the wearer's outer ear concha.

Figure 2A:
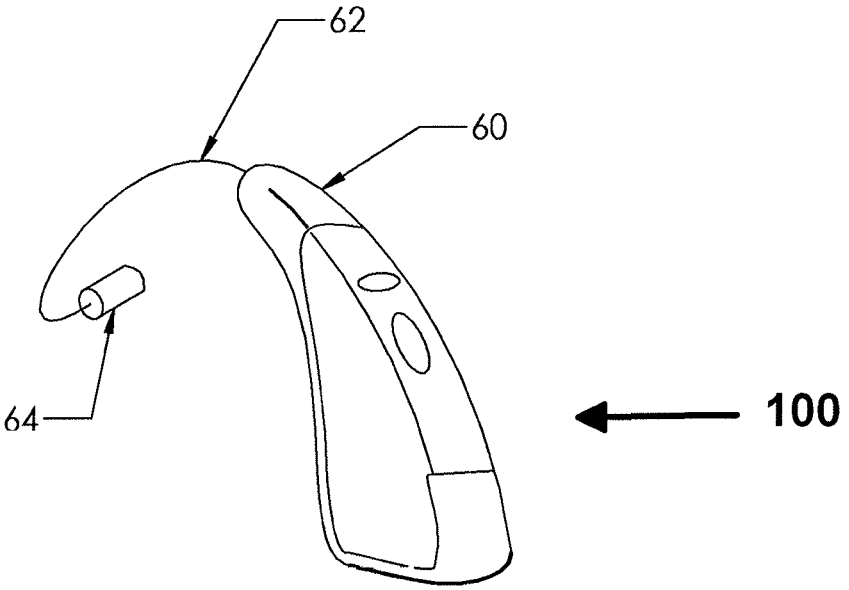
FIG. 2A illustrates a typically shaped behind the ear electronic amplifier with a connecting wire to a small speaker (transducer) for inputting electronically amplified sound into the hearing enhancement device at the top of the outer ear or ear retention insert, according to an aspect of the disclosure.

FIG. 3 illustrates how an electronic amplifier unit 60 mounted behind the upper pinna of the type illustrated in FIG. 2A may be combined and connected to earpiece 1 which is inserted and retained in the user's outer ear concha to form a composite hearing enhancement device 100 as shown in FIG. 3.

The electronic amplifier unit 60 may be connected electronically to speaker (transducer) 64 by a wire 62 of selected length that extends over the top of the user's upper outer ear pinna and along the side of his head to transducer 64, which is inserted into a directional transducer mounting boss 50 on rearwardly facing convex surface 42 through upper transducer hole 64A formed in the top area of earpiece 1. Through hole 64A may be positioned to direct the transducer toward the inner circumference of the concha, and the transducer 64 may be inserted to a depth selected for optimal gain position. This depth may be adjustable by the user or the mounting boss may be configured to position the transducer to an optimal depth. The length of the mounting boss 50 can provide for some fine-tuning of the speaker transducer location and also the depth of the connecting electric wires, for example, wire 62, as illustrated, for example, in FIGS. 2A and 10A, so to allow adjustment of the positioning of the speaker transducer. In addition, or in the alternative, the length of mounting boss 50 may be configured and positioned to provide the user some ability to tune and thus to adjust it for better outside room speech comprehension. The length of mounting boss 50 can provide for some fine tuning or adjustment of the gain and effect of the sound from the transducer. The upper transducer mounting hole 64A may be directed to focus the electronically generated sound toward the concha's inner upper circumference and downwardly by the user's outer ear so that the sound enters into the user's auditory canal and stimulates the tympanic membrane.

The increased circumferential length to the tympanic membrane (eardrum) is favorable for resonance reinforcement of the inputted lower frequencies from electronic amplifier 60 to earpiece 1 at opening 64A as shown in FIG. 3.

Figure 2B:
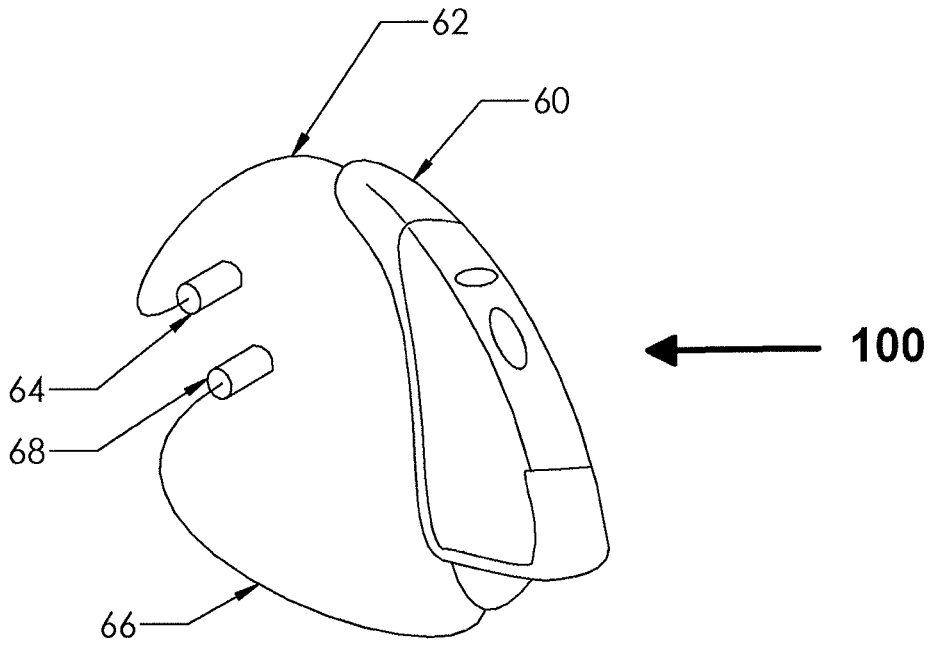
FIG. 2B illustrates the electronic amplifier as in FIG. 2A but with two small speakers (transducers) for inputting electronically amplified sound into the hearing enhancement device at the top and bottom of the outer ear or in an upper and lower ear transducer retention inserts, according to an aspect of the disclosure.
Figure 5:
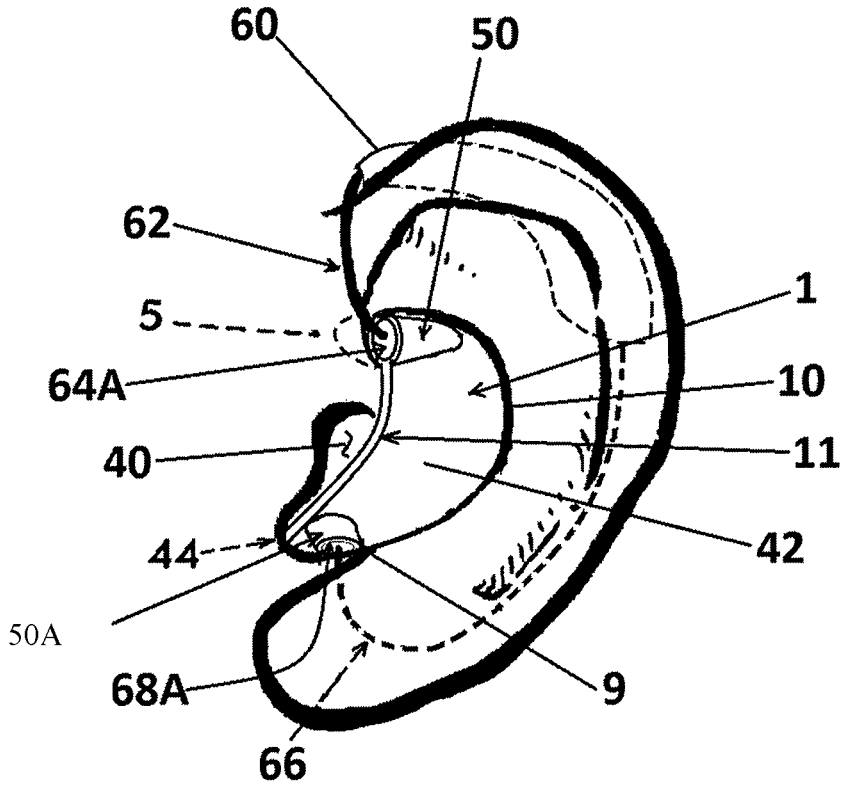
FIG. 5 illustrates another configuration of the enhancement device with two locations for inputting electronic amplified sound into the hearing enhancement device, according to an aspect of the disclosure.

FIG. 5 illustrates a configuration in which an additional transducer 68 (shown in FIG. 2B) may be inserted into another directional mounting, transducer boss 50A on the lower portion of the rearwardly facing convex surface 42 in through hole 68A. Hole 68A directs the inserted transducer's output directly into the user's ear canal to the tympanic membrane for most favorable higher frequency resonance reinforcement against the user's tympanic membrane while retaining a fully open ear at the earpiece entrance area 40.

Figure 4:
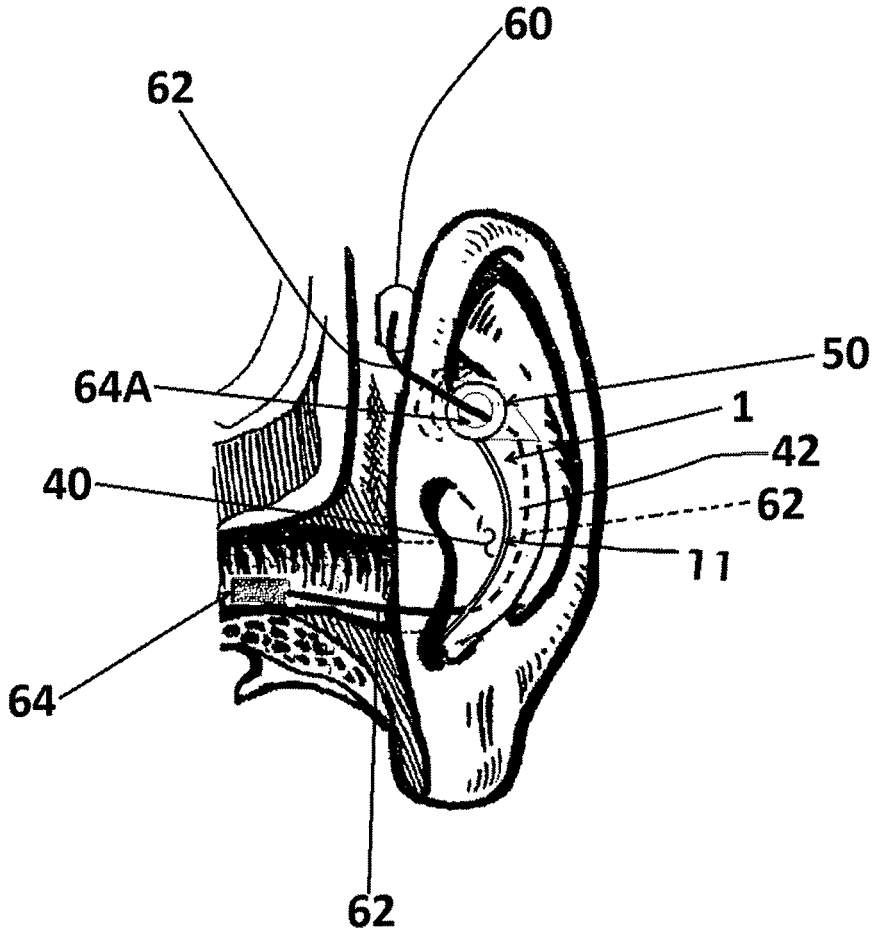
FIG. 4 illustrates a partial cross-section of the human left ear from the pinna into the auditory canal with a hearing enhancement device in place and the electronic amplifier behind the outer ear pinna as in FIG. 2, but with the amplifier connecting wire passing through the transducer entry hole at the top of the enhancement cup and continuing down and into the auditory canal at a selected optimum distance from the eardrum, according to an aspect of the disclosure.

Another configuration of the hearing enhancement device is shown in FIG. 4. Transducer 64 may simply be inserted through opening 64A in the earpiece 1 with sufficient electrical connection wire 62 for transducer 64 to be positioned in the ear canal and directed at the user's tympanic membrane to provide maximum sound power transfer to the tympanic membrane while retaining the ear canal essentially fully open for the user to sound frequencies which he can normally hear. Transducer mounting boss 50 is adjacent entry opening 64A of convex surface 42 of earpiece 1. Electrical connection wire 62 that runs to transducer 64 may be thin, and the transducer 64 may be small, so as to avoid substantial blockage of the ear canal and interference with sound waves propagating through the ear canal.

Figure 6:
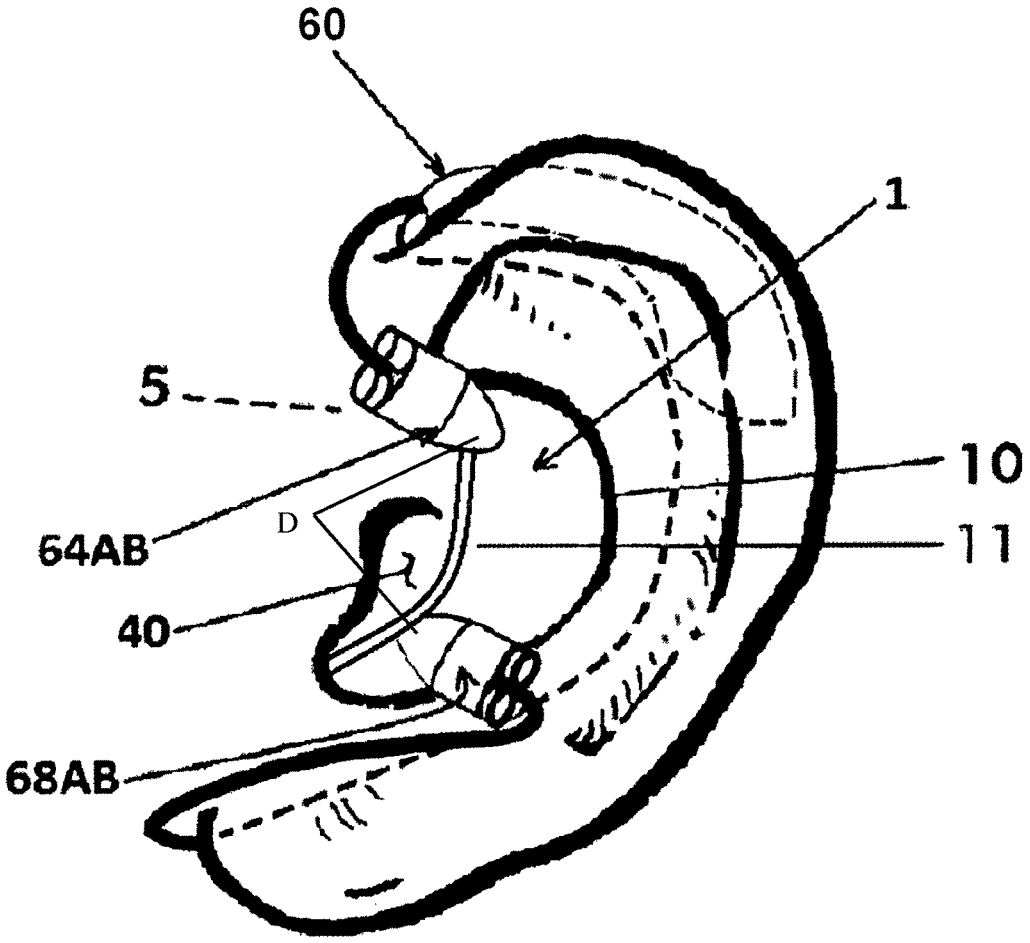
FIG. 6 illustrates the hearing enhancement device mounted in the left outer ear with two high performance earphone type diaphragms, copper coil driven speaker transducers which generate sound wave inputs to the cup with very high quality, according to an aspect of the disclosure.

FIG. 6 shows earpiece 1 inserted in concha, the earpiece with two high sound quality, coil driven, small diaphragms D. Although described as a "cup," various shapes are contemplated for earpiece 1, and it need not be cup shaped or concave on one side. One drive can produce the entire audio range, but two are shown in FIG. 6 with inputs to earpiece 1 at the upper transducer input 64AB and lower transducer input 68AB. This provides input locations for sound input to provide the best resonance enhancement of selected frequencies as provided by the two different best resonance location input. Also provides some reverberations and richens the sound quality heard by the user.

The user still has his outer ear fully open to outside surrounding sounds, but has the benefit of resonance and reverberation enhancement for the music inputs.

Thus, with the outer ear transducer inputs 64AB, 68AB for hearing comprehension enhancement of the present disclosure, the user's outer ear remains fully open to hear surrounding sounds that would be adequate for speech understanding. At the same time, needed additional high frequency speech phonic components and/or other sounds may be added into the fully open ear canal without causing feedback, squeal or whistle via transducers 64 and 68 positioned in transducer inputs 64AB, 68AB. There may thus be no need for hearing aid amplifier 60, as all input may be provided by a music source such and a smart phone using a blue tooth or other wireless connection, for example, to provide all of the sound amplification, as now done by hearing aids. There is no need to reproduce what can normally be heard by the user if the hearing aid were not sealed into the ear of the user.

Just as speech generation by the human body uses vocal cords to generate the various sinusoidal frequencies and the throat and larynx to provide the resonating chamber to form the complex wave form of speech, the user's ear canal and concha form a resonating chamber for wave amplification of the incoming surrounding sound with added selective frequency amplitude gain provided by the electronic amplifier circuits.

Also, when the user's outer ear and ear canal remains fully open, the user benefits from the normally produced 20-30 dB gain naturally provided by the outer ear and ear canal.

Figure 9:
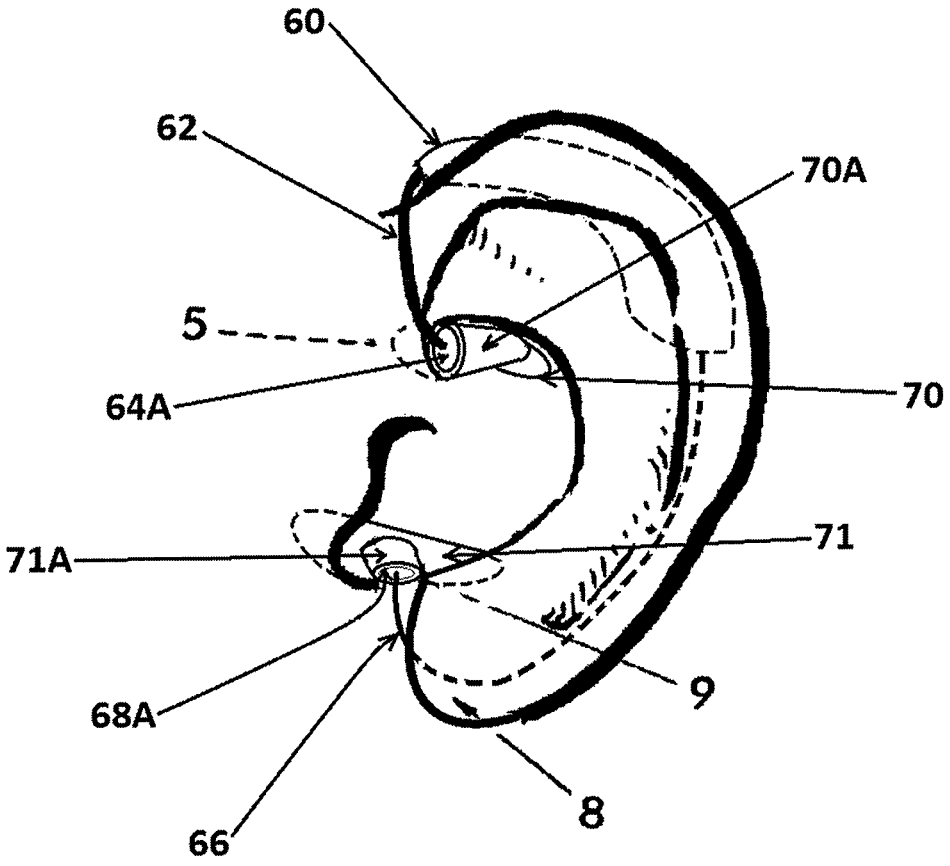
FIG. 9 illustrates the outer ear retention form for holding the transducer in the proper position for inputting selected sound component frequencies into an open external ear to optimize the inherent frequency enhancements of the outer ear, according to an aspect of the disclosure.

According to an aspect of the disclosure, the entire earpiece 1 may be eliminated and replaced with speaker (transducer) mounting retention ear mold pieces or retention members 70, 71, as illustrated in FIG. 9, that each maintain a small (transducer 64, 68 in a desired direction and location for resonance enhancement in the outer ear for desired frequency ranges. Instead of an outer insert earpiece 1, additional selectively needed frequencies as determined by the Fourier analyzer may be introduced into the outer ear and ear canal by small electronic transducers 64 and 68 directed into the concha and ear canal at a selected distance from the eardrum (tympanic membrane). In this case, the ear canal may be used as a resonator for mixing the low amplitude additional high frequency sound provided from these electronic transducers 64 and 68 to provide a boost for the high frequency components, for example, of speech's complex waveforms for the eardrum. One benefit may be the reduced amplitude required for the high frequency enhancement boost, since the resonance provided by the ear canal already provides some amplification of the sound. Thus, the outer ear and ear canal may remain fully open to receive the outside ambient sound in a normal way without the need to amplify and to reproduce everything the user hears with a very miniaturized transducer 64 and 68 providing sound discharged into the ear canal through very small diameter speaker opening.

Also disclosed is an external earpiece 1 for open ear hearing enhancement as an input for high quality ear bud type earphones, while allowing a portion of the outer ear to remain open to normal sound is new. It has been found that the state of the art small ear bud headphones, when put into the outer ear concha and when sealed to the ear canal with their soft rubber flaps, actually cause the ear canal to be a closed tube that vibrates with certain frequencies (around 7-8.8 kHz), which can drown out other frequencies. The open tube configuration of the disclosed ear cups with speaker component added eliminates this problem and may provide many other advantages for quality and sound reverberation for enhanced music hearing pleasure.

The inside of earpiece 1 may be designed with small or large ridges at selected distances from the eardrum and functional surfaces in the ear canal to the eardrum to provide sound feedback and multiple resonances for several different specifically desired frequencies, which may be controlled or tuned by the height and length of these small ridges, as well as the lengths between surfaces.

When ear phones are sealed to the ear canal, the ear canal vibrates with certain frequencies (around 7-8.5 kHz) which can drown out the other frequencies. The devices disclosed can solve this problem.

As previously discussed, FIG. 9 shows another way of attaching the amplifier transducer(s) to a user's outer ear to provide additional sound input to the user's outer ear, which is otherwise completely open to all ambient sounds and takes advantage of the benefit of the user's outer ear sound conditioning to provide sound to his tympanic membrane for optimum user comprehension. FIG. 9, for example, illustrates that there is no forward facing outer ear cup, and thus the ear canal passage and the entire outer ear remain fully open to all surrounding sounds as they normally would be. However by directionally inputting the sound into the user's outer concha at gain levels below what causes feedback and whistling, the user may obtain the benefit of this level of high frequency sound input and further benefits by directing the speaker transducer in such a way as shown in FIG. 9 so that these lower gain levels of higher frequencies amplitude are further enhanced by the out ear's natural resonances.

As shown in FIG. 9, transducer retention members 70 and 71 may be provided for holding the speaker transducer in the properly directed input position in the outer ear concha for inputting selected electronically generated sound frequency components into an open external ear to optimize the user's hearing comprehension while optimizing the inherent frequency enhancement of the outer ear presentation to the user tympanic membrane as stated above.

As previously discussed, in an embodiment, the cylindrical length of the transducer input holes 70A and 71A (see FIG. 9) may be set to allow for insertion depth adjustment for optimizing the resonance and reverberation of the outer ear cavities. These transducers retention (mounting) members 70 and 71 may be made in standard sizes or from a patient's ear mold dimensions. As for the earpiece as described previously, the plastic material should be flexible and preferably clear.

It is possible to produce a tone of any desired quality and complexity such as complex language wave forms from pure tone components or to reduce by computer mathematical Fourier analysis, complex frequency components.

Since the pitch of normal human speech is between 80 Hz and 300 Hz for males and above 250 Hz for soprano voices, these frequencies should be within the functional range of most people even with mild or moderate hearing loss.

However, human speech contains phonic units comprising complex wave frequencies, which include higher frequency sound components. As discussed, typical age-related human hearing loss typically centers on loss of ability to hear these higher frequency sound components. According to an aspect of the invention, these higher component frequencies are supplied at above hearing threshold amplitudes for the user by speaker transducer 64 and additional speaker transducer 68.

Figure 7:
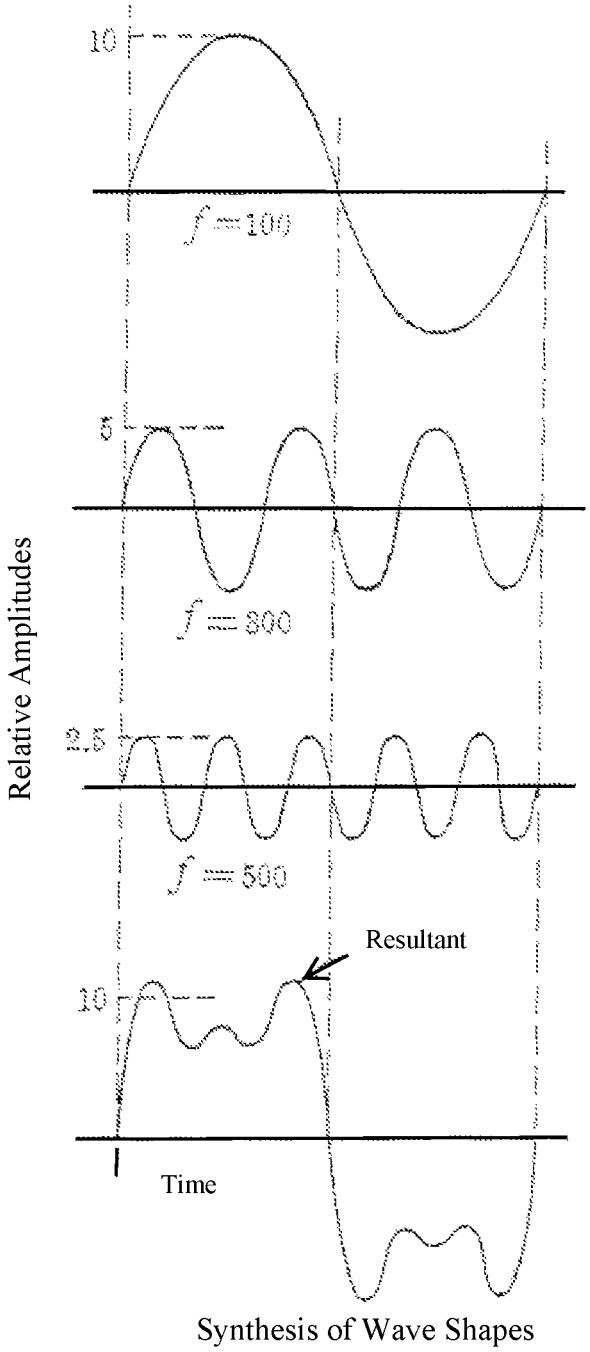
FIG. 7 illustrates a complex wave form for a voice vowel sound as shown at the bottom with the bottom curve illustrating that which can result from the combining of the top three different sinusoidal frequencies and different amplitude in curves along the times axis as shown.

FIG. 7 shows a complex wave form for a vocal vowel sound. The upper three different frequencies sine wave curves along the same time axis at the amplitudes as shown plotted when combined, produce the resulting complex wave form of a speech vowel in this example.

The complex wave (the bottom curve) in this example has a relative amplitude of 10 while its high frequency components of the amplitude 10 complex vowel voice sound only need to have a relative amplitude of 2.5 for the hearing to have a level relative gain of 10, in this example, for the vowel language understanding. Thus the high frequency components of speech once separated out from complex speech signal can be provided at much lower amplitudes than the pure tone gain level to replace hearing loss.

Figure 8:
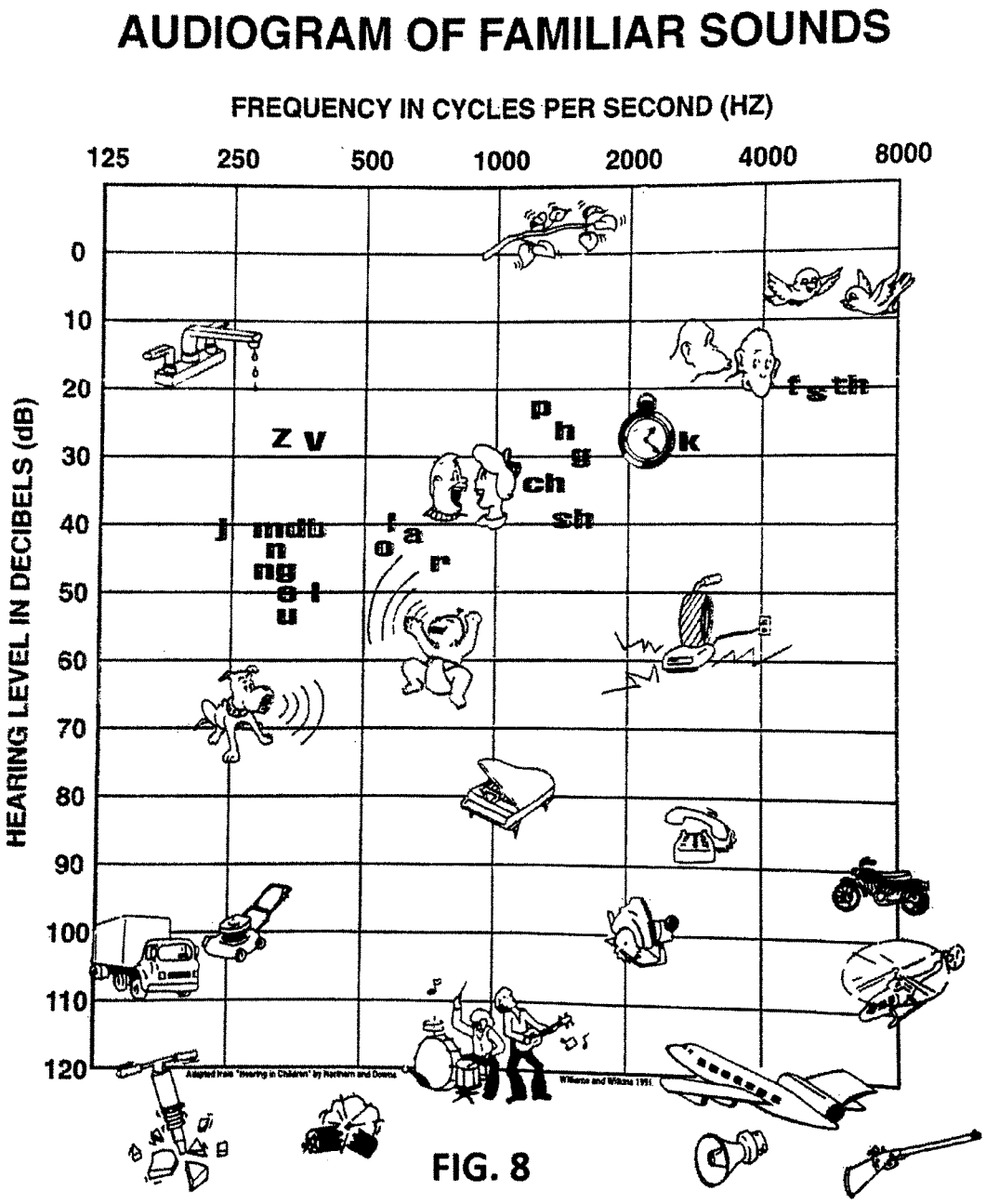
FIG. 8 illustrates an audiogram of the frequencies of common sound and the high frequency component of the various speech vowels and consonants.

FIG. 8 is an audiogram of familiar sounds and the frequencies at which they occur. The basic frequencies and overtones produced by air columns and the relation between the wave length (λ) and the length of the air column or spacing between the surface or eardrum may be calculated by the following expression:

$$F = \frac{mv}{2l}$$

where v is the velocity of the sound wave (1100 ft./sec) in air, n is the number of loops (half cycles) formed in between the reflecting or open areas with length l between them, and l is the distance between the transducer speaker output and the tympanic membrane.

Therefore, the added high frequency components of the human voice corresponding to phonic sounds of language can be at much lower amplitude for the user where he has hearing loss using the Fourier mathematical harmonic analyzer to provide the sound supplemented to the user's ears as provided for in the prior discussion and Figures. Harmonic analyzer circuits that analyze sound frequencies and provide an inventory of frequencies present in a frequency band or range received are well known. Such circuits, which may be provided on an automated microprocessor or chip, can also analyze speech sounds using speech component identifier circuitry. A harmonic analyzer may use Fourier mathematical analysis of the complex waveforms of human speech to separate out component frequencies where the hearing enhancement device user has hearing loss, and amplify them to the extent necessary for them to be above his or her threshold hearing at these frequencies where he or she has hearing loss. For example, voice recognition software and automated dictation devices that convert speech to text are well known and may include such technology to convert sound waves to electronic signals, and to analyze the signals as necessary. Also known are band pass filters that filter out all but a band of an electronic signal, and thus may be used to remove all but signals corresponding to human speech sounds or frequency bands thereof.

Figure 10A:
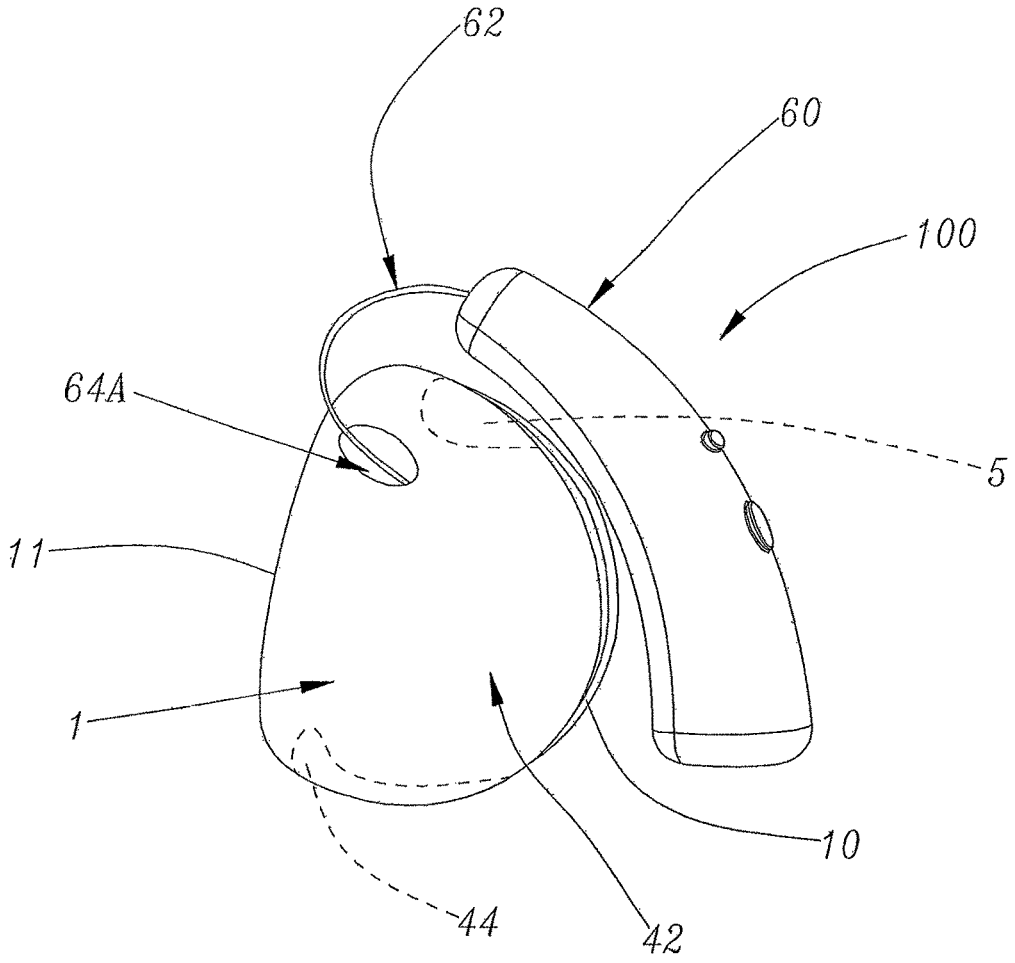
FIG. 10A is an approximately twice sized left ear perspective view of an example of a hearing enhancement device for insertion and retention in the user's outer ear concha with provision for also inputting electronically amplified sound into the user's outer ear and ear canal by the behind the ear pinna type electronic amplifier, according to an aspect of the disclosure.
Figure 10B:
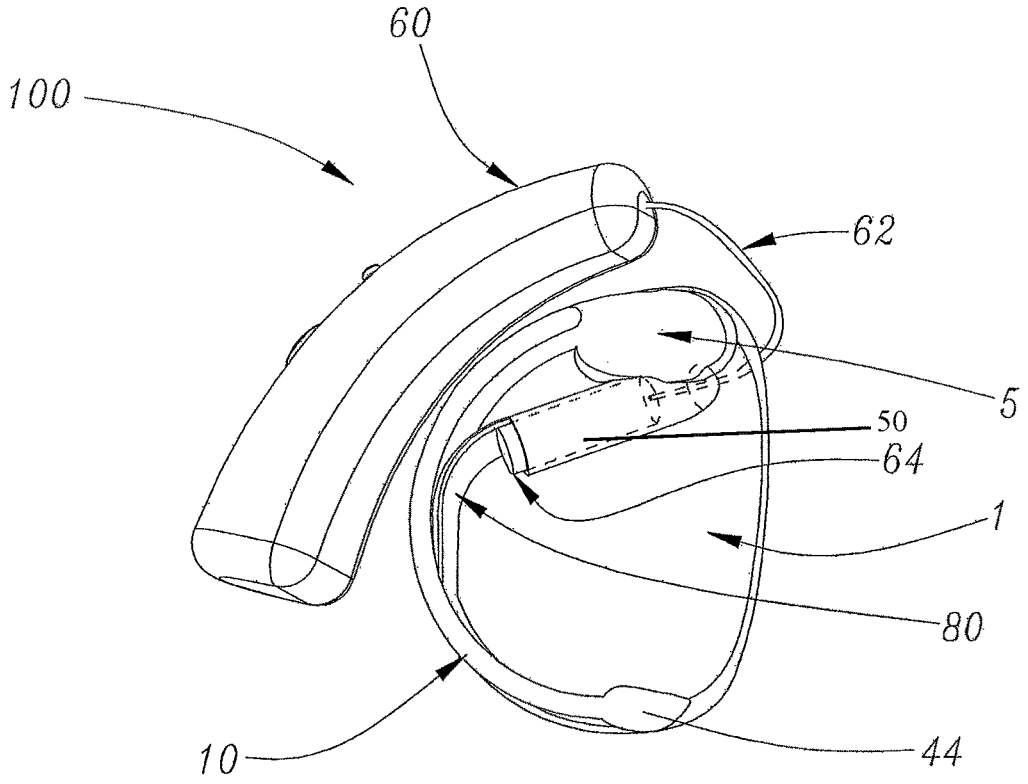
FIG. 10B is an approximately twice sized backside perspective view of an example of the hearing enhancement device of FIG. 10A, according to an aspect of the disclosure, according to an aspect of the disclosure.
Figure 10C:
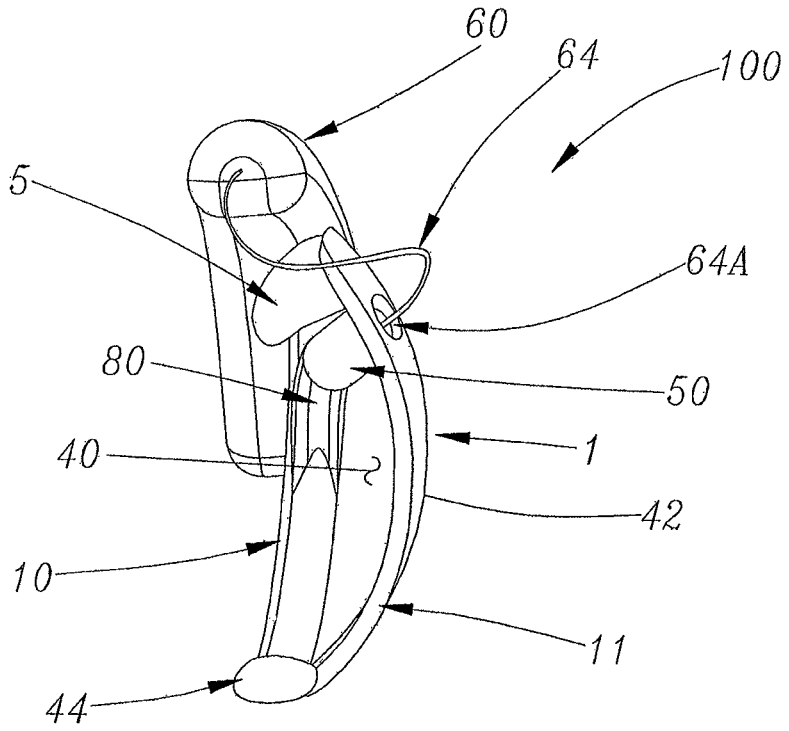
FIG. 10C is an approximately twice sized front view of an example of the hearing enhancement device of FIG. 10A looking straight into it as it is in the user's outer ear as shown in FIG. 1, according to an aspect of the disclosure.

FIGS. 10A-10C illustrate another example of a hearing enhancement device 100 that includes an earpiece 1 that is inserted into the user's ear and held in place in the cartilage thereof via the upper retention lug 5 and lower retention tip 44 in a manner similar to that described above with respect to FIG. 3. In this embodiment, the entry opening 64A is formed on the outer convex surface 42 for entry of the transducer 64 (see FIG. 10B) into the earpiece 1. The transducer 64 is connected to the electronic amplifier 60 via the wire 62. The transducer mounting boss 50 in this embodiment is positioned substantially on the inner concave surface of the earpiece 1. A composite hearing enhancement element or rib 80 is also provided on this interior surface and is positioned and shaped to provide direction for the sound waves from the transducer, in combination with the user's concha and auditory canal, to enhance the amplitude of reproduced sounds provided by the transducer 64. The enhancement provided by the composite hearing enhancement element 80 and the structures of the user's ear provides sufficient enhancement at the user's tympanic membrane such that the electronic amplifier need not provide amplification at a level that would provide feedback.

Figure 11A:
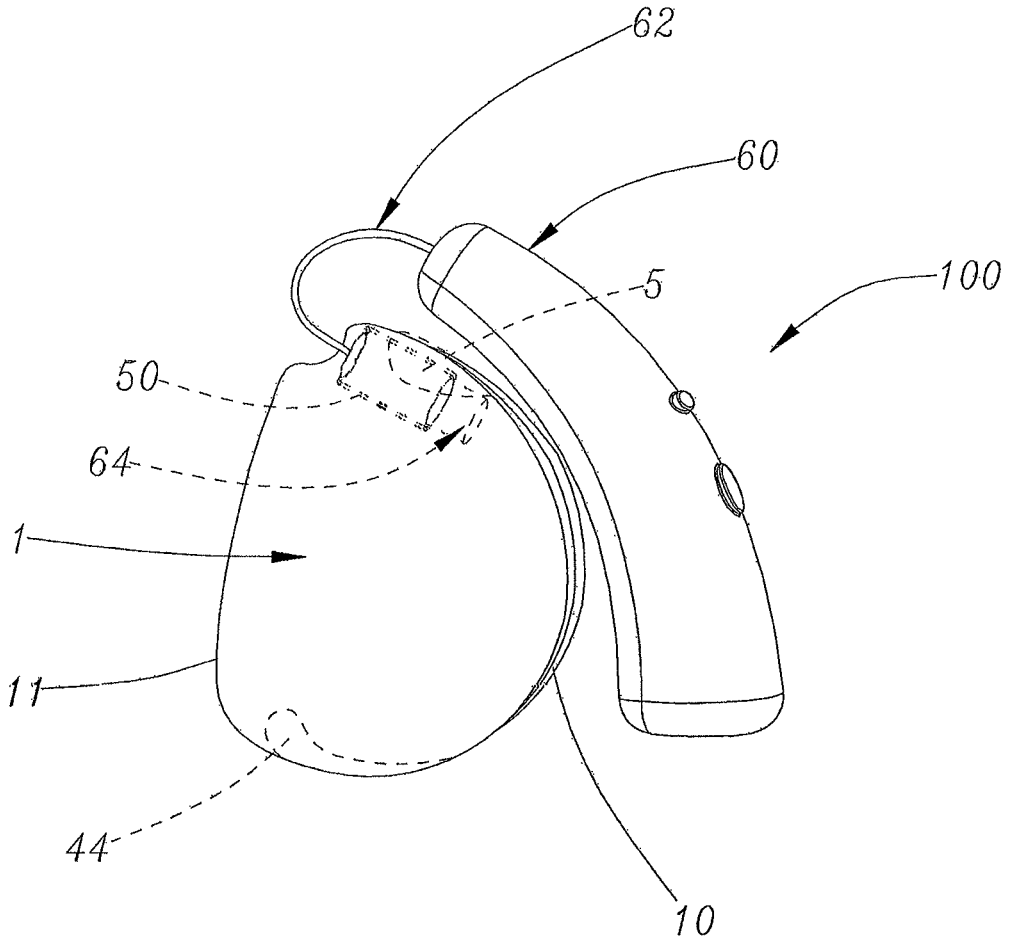
FIG. 11A is a perspective view of an example of a shape of the ear piece cup and how the transducer bosses are positioned on it, slightly different from the configuration of FIG. 10A, where the forward cup edge is extended further forward for tuning according to an aspect of the disclosure.
Figure 11B:
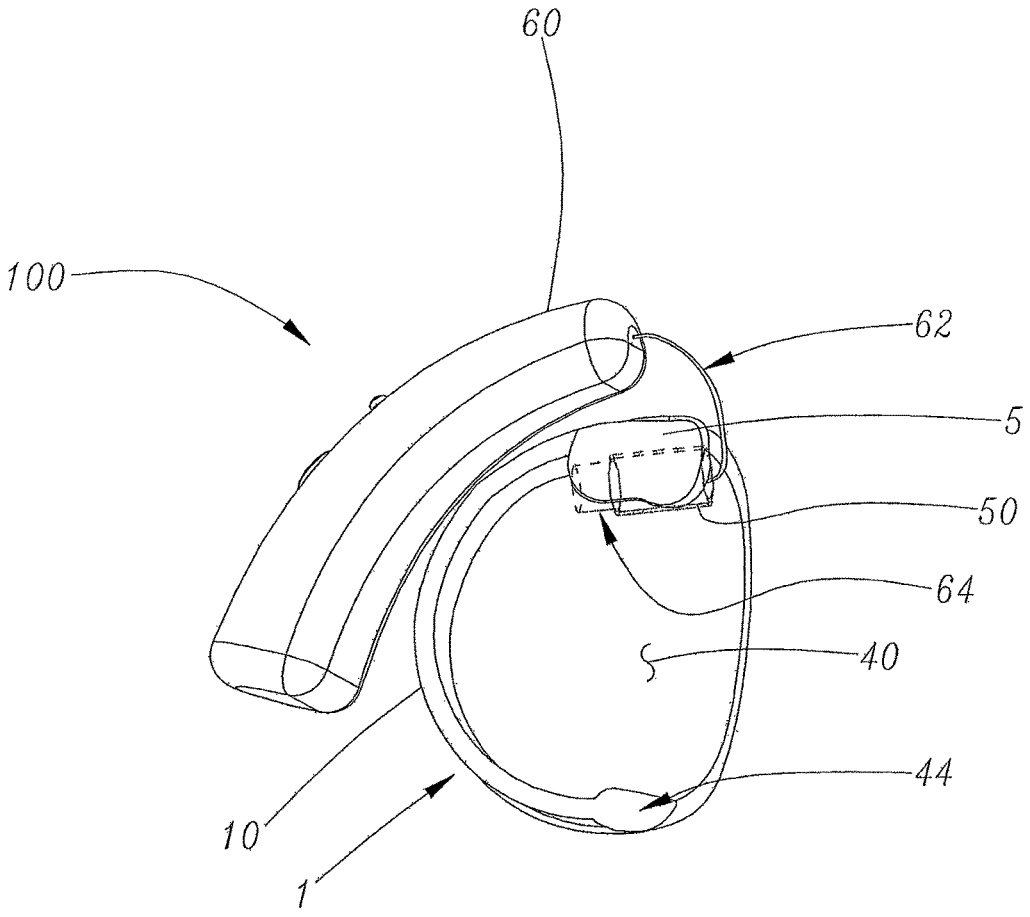
FIG. 11B is a perspective back view at twice actual size of an example of the ear cup insert of FIG. 11A, according to an aspect of the disclosure.
Figure 11C:
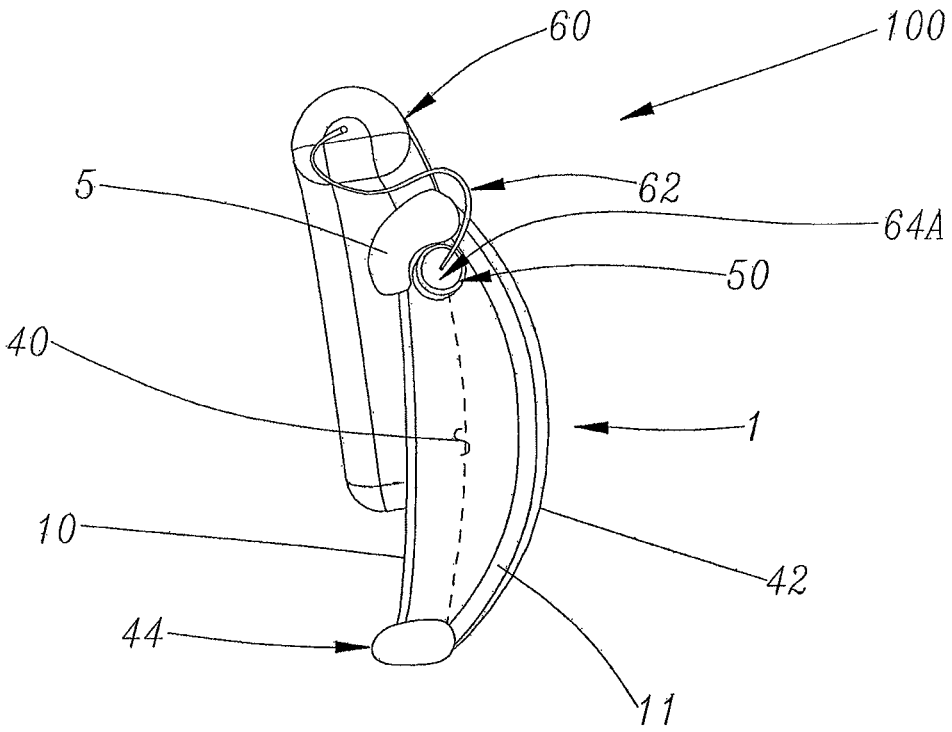
FIG. 11C is a forward looking view into the example of the cup of FIG. 11B, according to an aspect of the disclosure, according to an aspect of the disclosure.

FIGS. 11A-11C illustrates another example of a hearing enhancement device 100 that includes an earpiece 1 that is held in place by the cartilage in a user's ear substantially in the manner described above with respect to FIG. 3. In this embodiment, there is no need for an entry opening 64 in the convex surface 42. The transducer mounting boss 50 is provide on the inner concave surface of the earpiece 1 near a top edge thereof such that the transducer 46 and wire 42 are merely passed around the front edge of the earpiece to allow the transducer to be mounted in the boss 50. The boss 50 is sized and positioned such that the sound reproduced by the transducer is directed to the user's concha and auditory canal such that it is enhanced by natural resonance. As a result, the electronic amplifier 60 need not amplify the sound provided to the transducer to the point where feedback occurs.

Figure 12A:
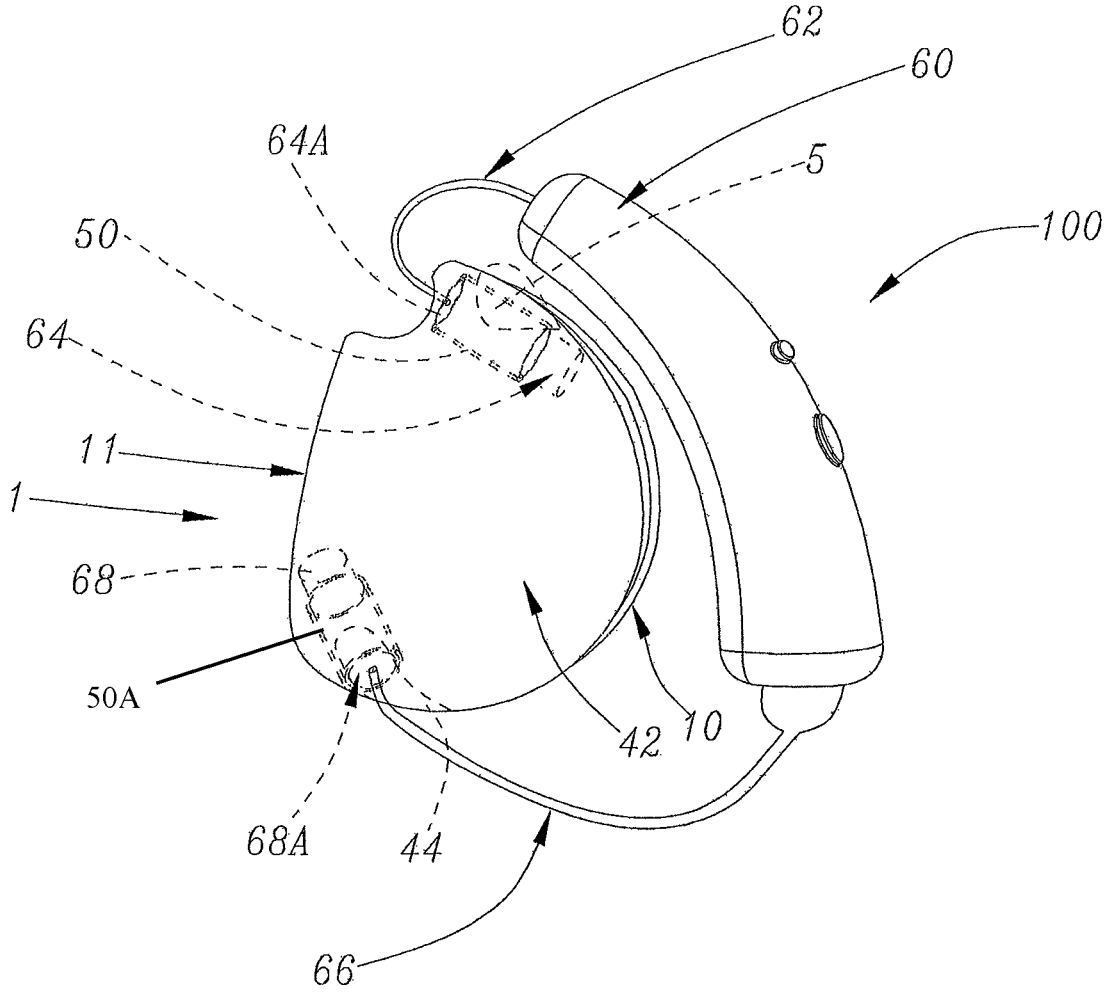
FIG. 12A is a detailed perspective view of the left ear of a user of the ear piece shown in FIG. 11A that includes a second sound transducer at the bottom of the ear piece for inputting higher frequency sound components in a more direct manner to the ear canal and ear drum by positioning the second transducer physically closer to the ear canal and the ear drum.
Figure 12B:
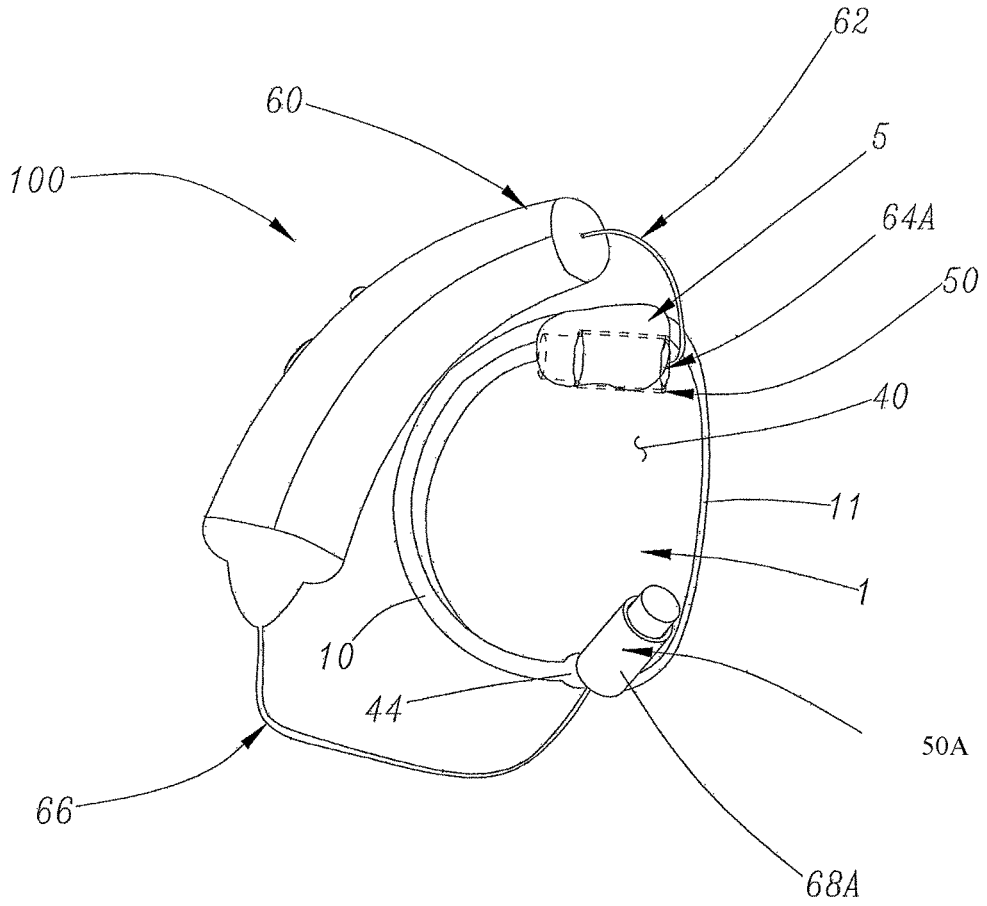
FIG. 12B is a back perspective view of an example of the two transducer ear piece of FIG. 12A, according to an aspect of the disclosure.
Figure 12C:
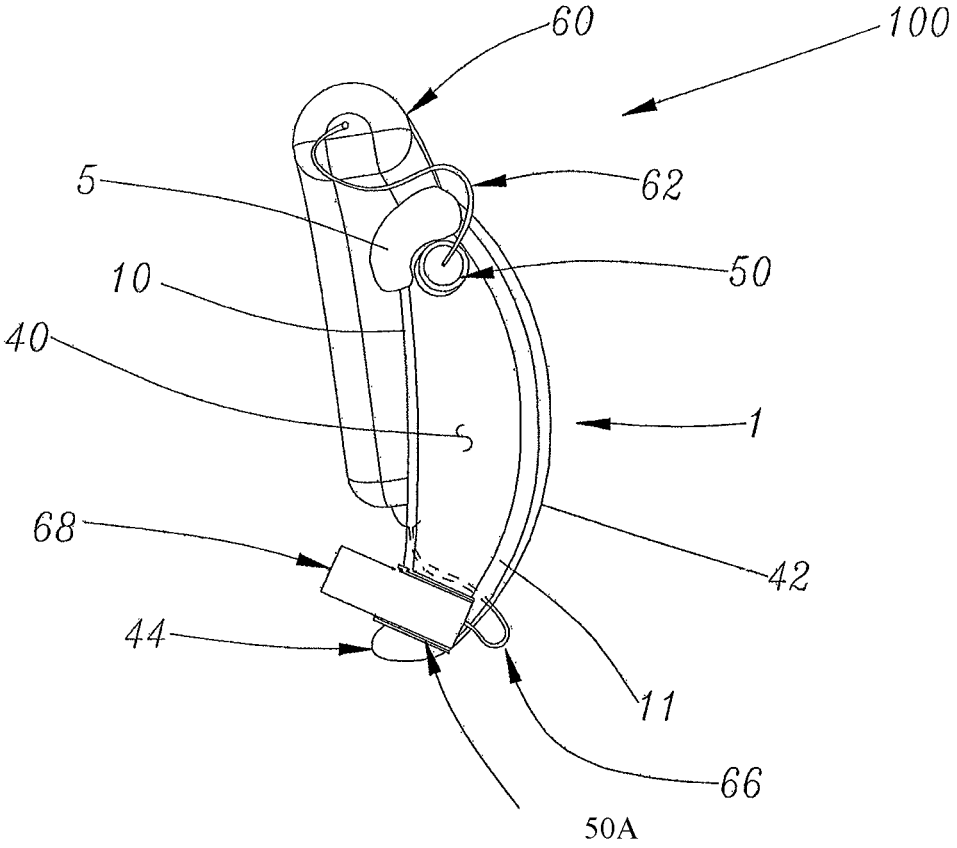
FIG. 12C is a forward looking perspective view of an example of the hearing enhancement device assembly of FIG. 12A, according to an aspect of the disclosure.

FIGS. 12A-12C illustrated another embodiment of a hearing enhancement device 100 that includes an earpiece 1 held in place in substantially the same manner as that of FIG. 3 described above. In this embodiment, two transducers 64 and 68 are connected to the amplifier 60 via wires 62 and 66, respectively. There is no need for any entry openings in the convex surface 42, however. Retention boss 50, in which transducer 64 is provided in the same position as illustrated and explained above with respect to FIG. 11A-11C such that the transducer 64 and wire 62 merely pass around a front edge of the earpiece 1. A second retention boss 50A is provided on the concave inner surface of the earpiece 1 near a bottom edge thereof such that the transducer 68, which is mounted in boss 50A passes around a bottom edge of the earpiece to be mounted in the boss 50A. In this embodiment, the amplifier 60 provides sound to the two transducers 64, 68 in much the same manner as described above with respect of FIG. 5.

Figure 13:
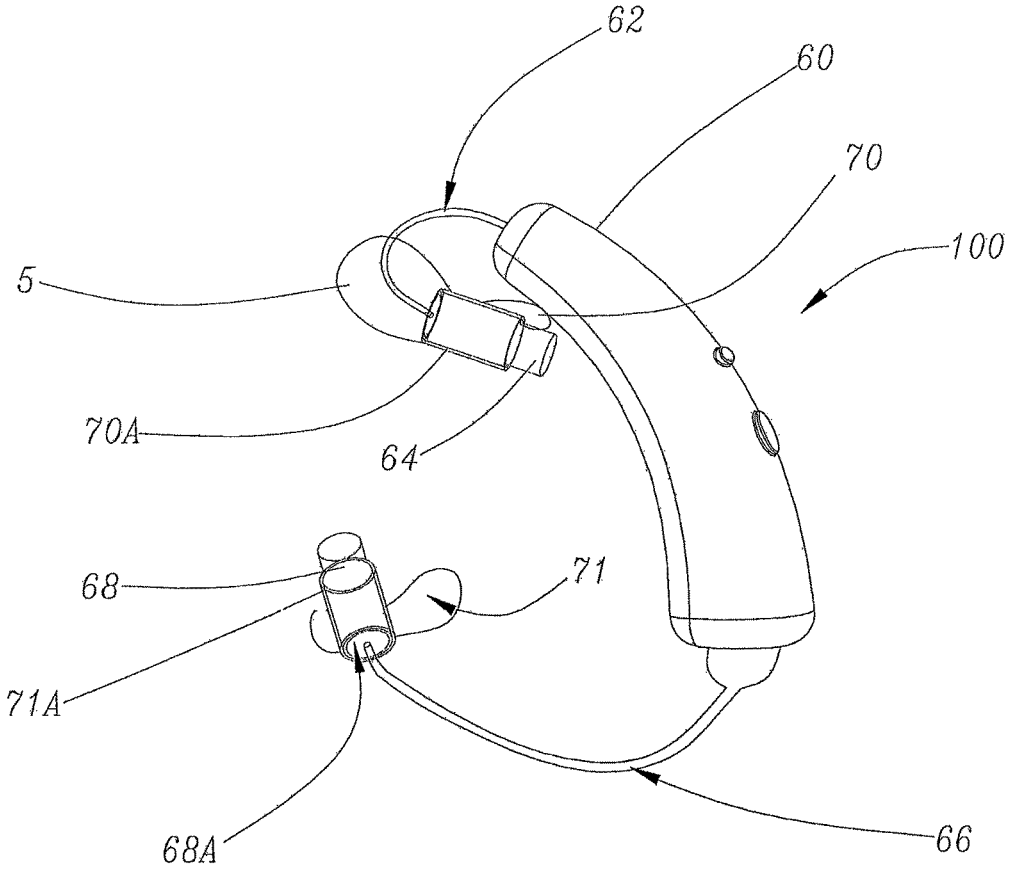
FIG. 13 is a perspective view of an example of the electronic amplifier with its two separate speaker transducers connected to an upper outer ear and lower outer ear insert mold for holding and directing sound from each of the two electronic speaker transducers into the outer ear concha and ear canal, according to an aspect of the disclosure with the outer ear cup.

FIG. 13 illustrates an embodiment of a hearing enhancement device 100 that does not include a full earpiece. Instead, as illustrated in FIG. 13, transducer retention members 70 and 71 are provided and held in place using the cartilage of the user's ear. In particular transducer retention member 70 includes the upper retention lug 5 and is positioned near a top of the user's ear. The transducer retention member 71 is position closer to a bottom of the user's ear. The transducer retention members 70 and 71 include transducer bosses 70A and 71A, respectively, in which the transducers 64 and 68 are mounted. The position and orientation of the transducers 64 and 68 is similar to that described above with respect to FIGS. 5 and 9.

Figure 14:
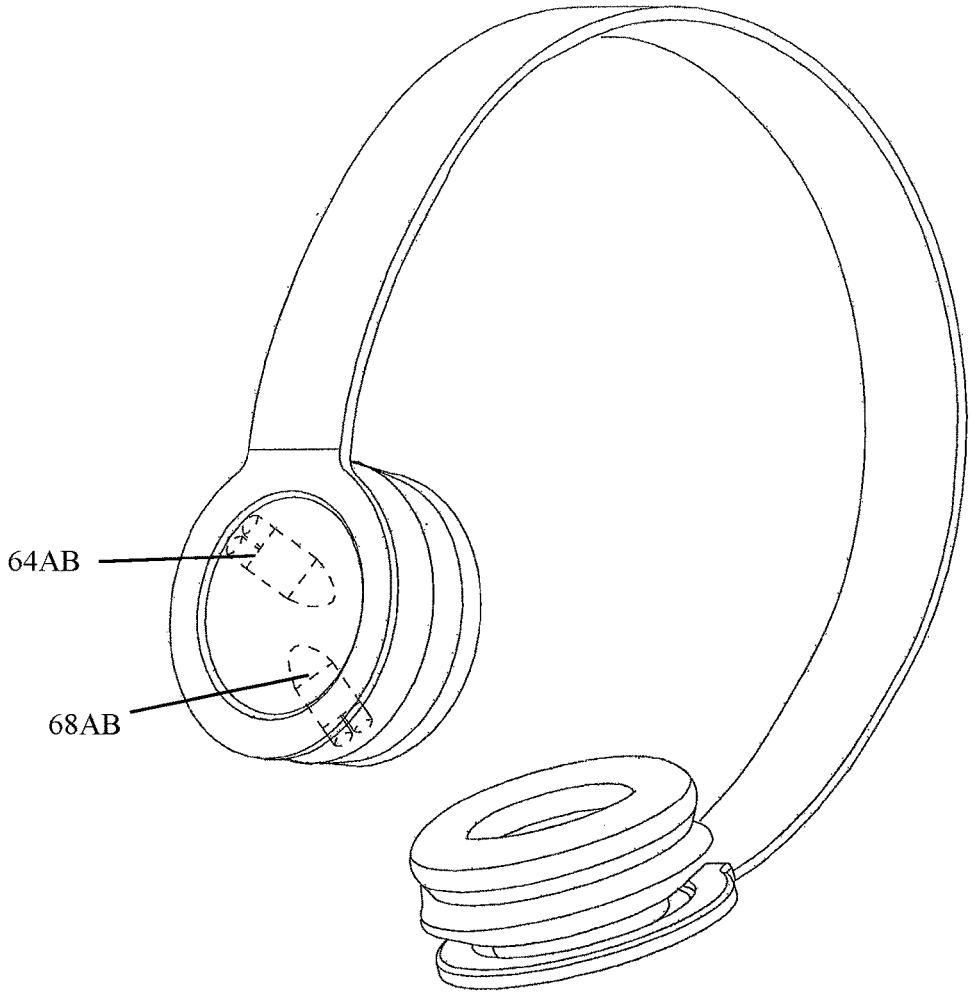
FIG. 14 is a perspective view of a headset configuration for listening to music incorporating the additional feature of reverberation and wave amplification by selected location of multiple speaker transducers in relationship to the outer ear cavity of the concha and the ear canal of the user.

In FIG. 14, the earpiece 1 is not used. The transducers 64, 68 are shown configured for listening to music and incorporate an additional feature for selectively amplifying lower and higher frequency sounds and providing reverberation wave amplification by selecting speaker location relative to the outer ear cavity and ear canal to provide fuller sound quality. That is, the positioning of the transducers relative to the outer ear cavity and ear canal provides for enhancement of certain frequency ranges. For this purpose, transducer inputs 64AB, 68AB are provided at selected positions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A hearing enhancement device comprising:

a first transducer, positioned adjacent to an ear of the user;

a first transducer retention member configured to receive the first transducer and connected to cartilage of a user's ear at a top thereof to hold the first transducer in a desired position, the first transducer movably mounted in the first transducer retention member to adjust a distance of the first transducer from an auditory canal of the user;

an electronic amplifier connected to the first transducer and positioned adjacent to the ear of the user and including a harmonic analyzer, the harmonic analyzer operable to separate a predetermined high frequency component from sound arriving at the user's ear using Fourier mathematical analysis and providing additional amplification only of the predetermined high frequency component, the signal amplifier connected to the transducer to drive at least the first transducer to produce only the predetermined high frequency component to the user's ear, wherein the first transducer retention member and first transducer are positioned and held in place by connection to cartilage to provide the predetermined high frequency component to the user's ear without obstructing an auditory canal of the user's ear.

2. The hearing enhancement device of claim 1, wherein the Fourier mathematical analysis separates the predetermined high frequency component frequencies from complex speech wave forms.

3. The hearing enhancement device of claim 2, wherein the first transducer is positioned so as to direct the predetermined high frequency component frequencies of speech directly toward the user's ear drum a selected distance from the user's ear drum.

4. The hearing enhancement device of claim 1, further comprising a second transducer configured to be driven at a frequency range different from the predetermined high frequency component frequencies of speech and directed to an inner circumference of the user's ear and the user's auditory canal.

5. The hearing enhancement device of claim 4, wherein the second transducer is positioned to direct sound at the user's auditory canal.

6. The hearing enhancement device of claim 1, wherein the electronic amplifier is configured to be positioned behind the user's ear.

* * * * *